United States Patent [19]

Leto

[11] 4,387,559

[45] Jun. 14, 1983

[54] FUEL BURNER AND COMBUSTOR ASSEMBLY FOR A GAS TURBINE ENGINE

[75] Inventor: Anthony Leto, Franklin Lakes, N.J.

[73] Assignee: Curtiss-Wright Corporation, Wood-Ridge, N.J.

[21] Appl. No.: 263,288

[22] Filed: May 13, 1981

[51] Int. Cl.[3] ..... F02C 7/20; F02C 7/22

[52] U.S. Cl. ..... 60/39.32; 60/39.463; 60/740

[58] Field of Search ..... 60/39.31, 39.32, 39.36, 60/39.37, 39.46 G, 39.46 P, 734, 739, 740, 746, 747; 239/397.5

[56] References Cited

U.S. PATENT DOCUMENTS

| | | | |
|---|---|---|---|
| 2,592,748 | 4/1952 | Sedillo | 60/39.46 G |
| 2,711,072 | 6/1955 | Wetzler | 60/39.37 |
| 3,032,990 | 5/1962 | Rogers | 60/39.32 |
| 3,775,975 | 12/1973 | Stenger et al. | 60/39.32 |
| 4,157,012 | 6/1979 | DuBell | 60/39.46 P |

*Primary Examiner*—Louis J. Casaregola
*Attorney, Agent, or Firm*—Arthur L. Frederick

[57] ABSTRACT

A fuel burner and combustor assembly for a gas turbine engine has a housing within the casing of the gas turbine engine which housing defines a combustion chamber and at least one fuel burner secured to one end of the housing and extending into the combustion chamber. The other end of the fuel burner is arranged to slidably engage a fuel inlet connector extending radially inwardly from the engine casing so that fuel is supplied, from a source thereof, to the fuel burner. The fuel inlet connector and fuel burner coact to anchor the housing against axial movement relative to the engine casing while allowing relative radial movement between the engine casing and the fuel burner and, at the same time, providing fuel flow to the fuel burner. For dual fuel capability, a fuel injector is provided in said fuel burner with a flexible fuel supply pipe so that the fuel injector and fuel burner form a unitary structure which moves with the fuel burner.

18 Claims, 3 Drawing Figures

FUEL BURNER AND COMBUSTOR ASSEMBLY FOR A GAS TURBINE ENGINE

The U.S. Government has rights to this invention pursuant to Contract No. EX 76-C-01-2291 awarded by the U.S. Energy Research and Development Administration (now the Department of Energy).

This invention relates to gas turbine engines and, more particularly, to a gas turbine engine having a fuel burner and combustor assembly in which the fuel burner supports the combustor housing or basket within the gas turbine engine.

BACKGROUND OF THE INVENTION

The use of coal derived fuels, particularly in the United States because of its vast coal resources, has become increasingly important as an alternative energy source. Unfortunately, the energy content of gaseous fuel derived from coal is considerably lower than that of natural gas. Approximately, 150 BTU of heat is in a cubic foot of gaseous fuel derived from coal by the Lurgi process as compared to 900 BTU of heat in a cubic foot of natural gas. In spite of the low energy content of gaseous fuel derived from coal (hereinafter referred to as "LBG fuel"), it is desirable to provide a gas turbine engine capable of utilizing LBG fuel. However, in a gas turbine electrical power generating system wherein the gas turbine engine is utilized to supply compressed air for producing LBG fuel from coal by the Lurgi process, there is no LBG fuel available to be burned in the gas turbine engine until it is produced in the gasification process. This necessitates that the gas turbine engine have the capability of burning, not only the LBG fuel, but another fuel, e.g. natural gas, for start-up purposes and until the system produces LBG fuel.

Heretofore, as exemplified in the following patents, gas turbine engines have been designed to have dual fuel burning capabilities:

U.S. Pat No. 3,991,561 Leto; Nov. 16, 1976;
U.S. Pat. No. 3,766,734 Jones; Oct. 23, 1973;
U.S. Pat. No. 3,517,679 Williamson; June 30, 1970;
U.S. Pat. No. 3,139,724 Nerad et al; July 7, 1964;
2,931,429 Brown; Apr. 5, 1960;
U.S. Pat. No. 2,854,819 Walker; Oct. 7, 1958;
U.S. Pat. No. 2,771,741 Barnard 4th; Nov. 27, 1956;
British Pat. No. 723,110 Morley; Feb. 2, 1955.

However, in the heretofore known dual gas turbine engines, the combustor and fuel nozzles or burners are independently supported so that problems of alignment and thermal differential expansion, between the combustor burner nozzles and the engine casing, exist.

It is, therefore, an object of this invention to provide combustor and fuel burner assembly for a gas turbine engine in which the problems of differential expansion and contraction and alignment of components are obviated in a simple manner.

It is another object of the present invention to provide a combustor and fuel burner assembly for a gas turbine engine which is relatively simple in construction and at the same time provides for support of the combustor housing and relative movement between the combustor housing and the engine casing.

It is a further object of this invention to provide a fuel burner and combustor assembly which is relatively inexpensive, simple in construction and having increased reliability over heretofore known combustor assemblies for gas turbine engines.

A still further object of the present invention is to provide a combustor and fuel burner assembly having dual fuel burning capability where disassembly and reassembly of the fuel system to switch from liquid fuel to gaseous fuel is obviated; where quick change from one fuel to another is achievable without shutdown of the gas turbine engine and where the engine can operate over a wide range of speeds.

SUMMARY

Accordingly, this invention contemplates a novel fuel burner and combustor assembly for a gaseous turbine engine.

The gas turbine engine has a casing, an air compressor section within the casing, a gas turbine section within the casing in axially spaced relation to the air compressor section, and a fuel supply port means communicating with a source of fuel and extending radially inwardly from the casing.

The fuel burner and combustor assembly comprises a housing and at least one fuel burner. The housing is disposed within the engine casing between the air compressor section and the turbine section. The housing defines therein a combustion chamber. The inlet port means is provided in the housing so as to communicate the combustion chamber with the air compressor section to pass compressed air from the latter into the combustion chamber. The housing is closed at one end and open at the opposite end to pass gaseous products of combustion from the combustion chamber into the turbine section to drive the latter. The fuel burner is attached at one end portion to the closed end of the housing so as to extend into the combustion chamber to pass fuel into the latter. The opposite end portion of the fuel burner slidably engages the radially extending fuel supply port means so as to to receive fuel from the latter for passage through the fuel burner. The fuel supply port means and the fuel burner coact to anchor the housing at one end against lateral movement and movement in an axial direction relative to the casing so that thermal growth of the housing is effected in a direction toward the turbine section, and at the same time, to allow relative movement between the combustor and casing in a radial direction while maintaining fuel flow through the fuel burner.

In a narrower aspect of the invention, the fuel burner includes a fuel injector disposed so as to emit a second fuel into the one end portion of the fuel burner for passage through the latter into the combustion chamber. A flexible fuel supply pipe is connected to the fuel injector and a source of a second fuel to provide for flow of the second fuel from the source thereof to the fuel injector.

The herein described novel fuel burner and combustor assembly provides for fixing the housing of the combustor axially, laterally and centrally within the gas turbine engine casing while, at the same time, providing the required allowance for the differential radial movement between the combustor housing and engine casing due to differential thermal expansion and contraction.

BRIEF DESCRIPTION OF THE DRAWINGS

The invention will be more fully understood from the following detailed description thereof when considered in connection with the accompanying drawings wherein an embodiment of the invention is illustrated by way of example, and in which.

DESCRIPTION OF THE PREFERRED EMBODIMENT

Figure 1:
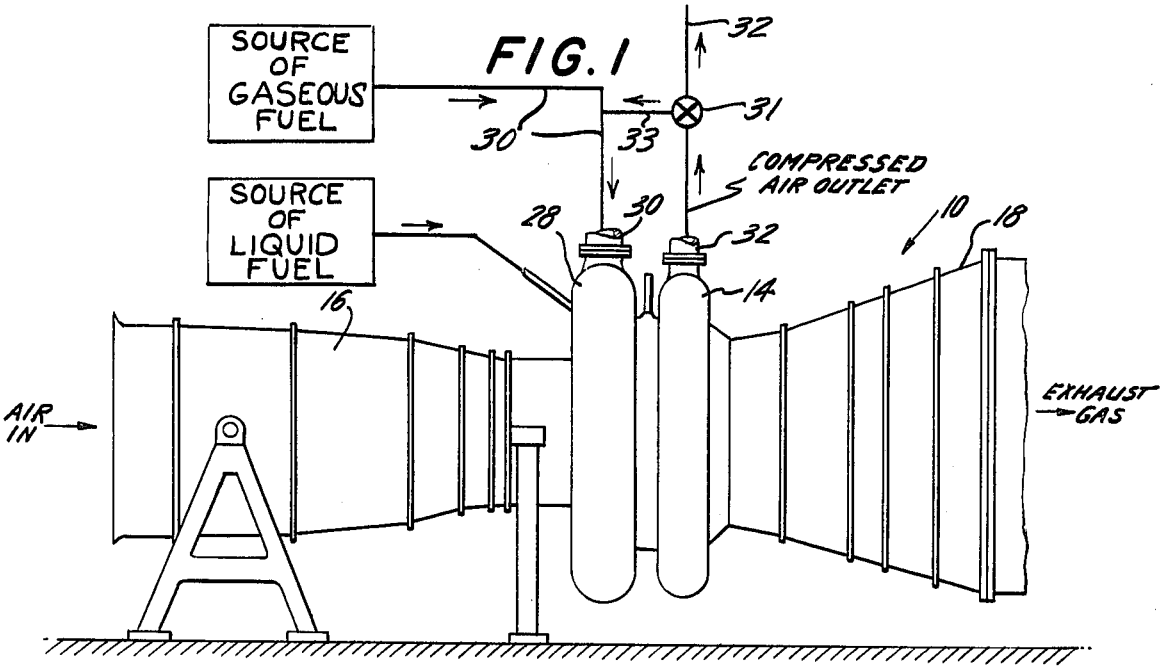
FIG. 1 is a side elevational view of a gas turbine engine which may be provided with the fuel burner and combustor assembly according to this invention and which gas turbine engine may be employed to produce compressed air required in a process plant, as for example the Lurgi coal gasification process.
Figure 2:
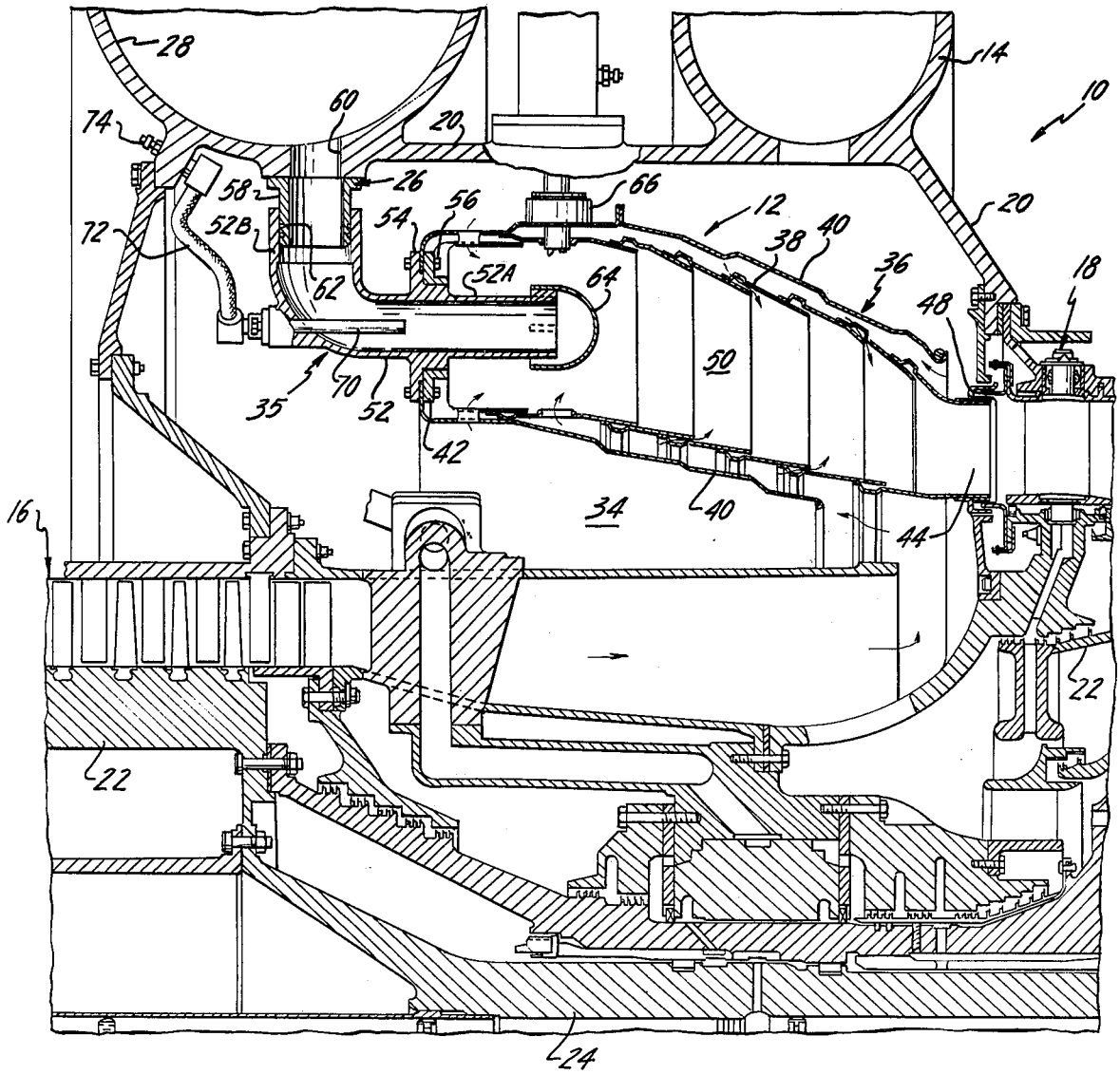
FIG. 2 is a fragmentary view in cross-section of the gas turbine engine shown in FIG. 1.

Now, referring to the drawings and more particularly to FIGS. 1 and 2, reference number 10 generally identifies a gas turbine engine having a fuel burner and combustor assembly 12 (see FIGS. 2 and 3) according to this invention.

Figure 3:
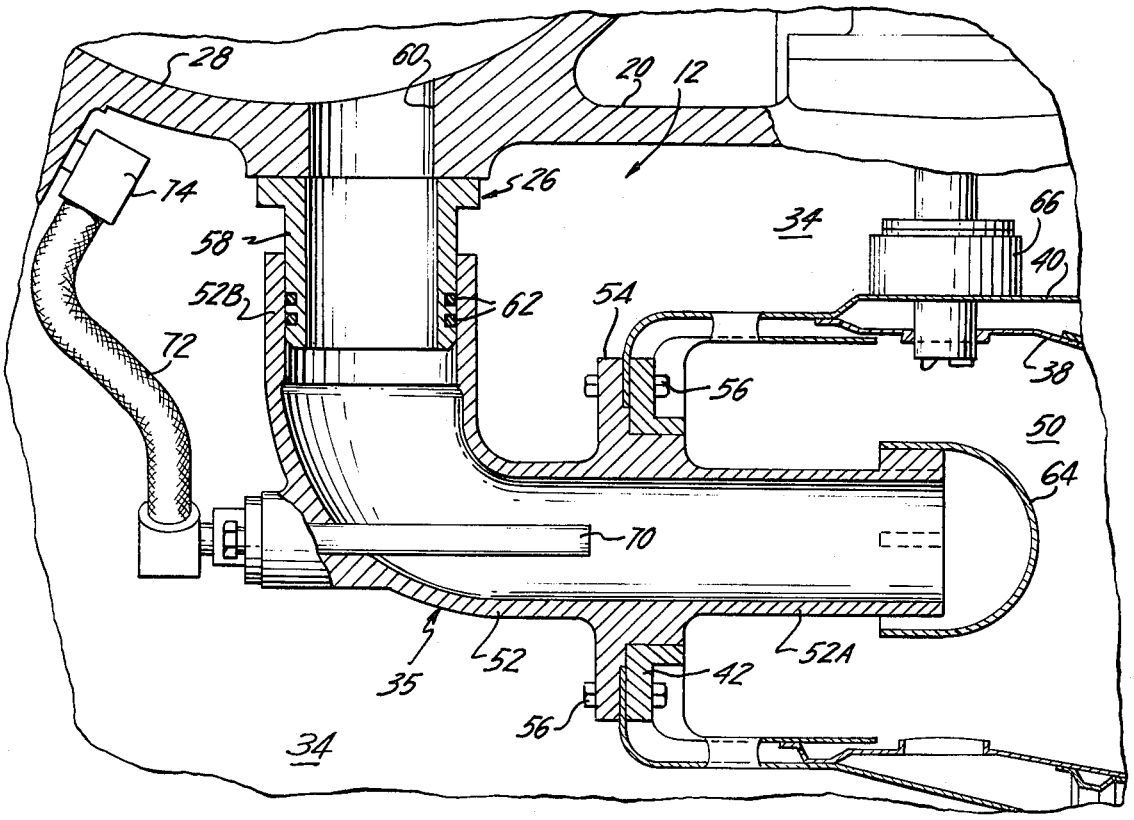
FIG. 3 is a view on an enlarged scale of the fuel burner and combustor assembly shown in FIG. 2.

The gas turbine engine 10 is shown as adapted for industrial use and the generation of compressed air, but the invention, while particularly suited to such gas turbine use, is not limited thereto. Merely for purposes of illustrating the utility and the dual fuel capability of the present invention, the gas turbine engine 10 is shown as functioning to produce compressed air to be used in a process plant, as for example a Lurgi coal gasification plant (not shown). Accordingly, gas turbine 10 is of a type which has an annular compressed air outlet manifold 14. The gas turbine engine 10, in addition to outlet manifold 14, has the conventional air compressor subassembly or section 16 and turbine subassembly or section 18 axially spaced from each other in a casing 20. The rotors 22 of air compressor section 16 and turbine section 18 are supported for rotation on a spool or shaft 24 which is journaled in suitable bearing (not shown) supported by casing 20. Also, gas turbine engine 10 has a fuel supply port means 26, which may, as shown, include an annular fuel inlet manifold 28 for LBG fuel. This fuel inlet manifold 28 is connected through a supply pipe 30 to a source (not shown) of fuel, such a LBG fuel produced in a coal gasification process plant. Fuel inlet manifold 28 and compressed air outlet manifold 14 may be separate elements or be constructed integrally with casing 20 as is shown in FIGS. 2 and 3. The compressed air outlet manifold 14 is connected via a pipe 32 to a place of use such as the reactor (not shown) of a Lurgi coal gasification plant (not shown). A crossover valve means 31 is provided in pipe 32 to control flow of compressed air into a bypass pipe 33 which communicates with pipe 30 so that some compressed air is bypassed to inlet manifold 28 when liquid fuel is to be burned in fuel burner and combustor assembly 12 and LBG fuel is not yet available for delivery through supply pipe 30. In the space between air compressor section 16 and turbine section 20, the casing 20 and conventional seals and baffling define therebetween a compressed air outlet plenum 34 within which is disposed fuel burner and combustor assembly 12.

The fuel burner and combustor assembly 12 comprises a basket or housing 36 and a plurality of circumferentially spaced fuel burners 35 (only one of which is shown in the drawings) which are connected to and project into the housing.

The housing 36 comprises the conventional air cooled wall comprising a plurality of partially overlapping segmental plates 38 and spaced baffles 40. The baffles 40 define with the segmental plates 38 a passageway for compressed air, which air maintains segmental plates 38 cool and enters the housing to support combustion therein. This type of combustor basket or housing is fully disclosed in the U.S. Pat. to Sneeden, No. 3,267,676, dated Aug. 23, 1966. As is conventional, housing 36 is closed at one end by an annular wall 42 and open at the opposite end 44, which end is supported, via a slipjoint connection 48, in the baffling defining compressed air plenum 34. The housing 36 defines therein an annular combustion chamber 50, which is in communication, through open end portions 44, with gas turbine section 18, to pass gaseous products of combustion from combustion chamber 50 into gas turbine section 18 to thereby drive the latter.

The fuel burners 35 each comprise a hollow, tubular member 52 of L-shape and having a radially extending mounting flange 54 projecting from axial or horizontal leg portion 52A. Each fuel burner 35 is disposed in an opening in housing end wall 42 with the flange 54 in abutment against end wall 42 and secured to the latter by bolts 56. The other radial or vertical leg portion 52B of each fuel burner 35 telescopically and slidably engages a threadless nipple 58 which forms part of the fuel supply port means 26. Each nipple 58 is secured to the inner surface of casing 20 in any suitable manner, as for example by bolts, not shown, so as to be in register with an outlet opening 60 and to project radially therefrom. As illustrated, the leg portion 52B has a diametral size so as to overlie and slidably engage the outer surface of the associated nipple 58. The interstices between the leg portion 52B and an associated nipple 58 is sealed by seal means 62. Each of the seal means 62 may, as shown, comprise two spaced annular grooves in the outer surface of each nipple 58 in which are disposed O-Rings or other suitable seals, e.g. piston rings. The distal end of each fuel burner 35 in combustion chamber 50 has the usual cap member 64 which serves as a baffle for promoting vaporization of the liquid fuel impinging the inner surface of the cap member before passing into combustion chamber 50. Associated with each fuel burner is an igniter 66 which functions to ignite the fuel on start-up and before self-sustaining fuel combustion is reached in combustion chamber 50. The fuel burners 35 function in cooperation with nipples 58 to anchor fuel burner and combustor assembly 12 in an axial direction and laterally with respect to casing 20 of the gas turbine engine. More specifically, this fixing of lateral and axial position is achieved by reason of leg portion 52B abutting nipples 58 fixed to casing 20. This cooperative relationship of fuel burners 35 and associated nipples 58 also provides for expansion and contraction of housing 36 relative to casing 20 in a direction toward turbine section 18 and slipjoint connection 48. At the same time, fuel burner and combustor assembly 12 is permitted to move radially relative to casing 20 of the gas turbine engine. Furthermore, any potential minor assembly misalignments between fuel burners 35 and their associated nipples 58 can be compensated for by suitable adjustments, as for example by adding or removing shims (not shown) between mounting flanges 54 and end wall 42. Since the burners 35 with respect to their associated nipples 58 are free-floating until bolted in place, no initial detrimental pre-stressing of fuel burners 35 can occur.

If, as previously stated, dual fuel capability is required because the application of gas turbine engine 10 is, as a generator of compressed air, for use in a reactor of a Lurgi coal gasification plant, each fuel burner 35 may include, as shown, a liquid fuel injector 70 which is supported in tubular member 52 so as to extend coaxially within horizontal leg portion 52B. Each of the fuel injectors 70 is connected to an external source of liquid fuel of high heat content by way of a flexible supply pipe 72 and connector 74 mounted on casing 20. Since the injector is a par of the fuel burner and combustor assembly 12, it is free to move together with tubular member 52 by reason of the flexible connection with casing 20 via flexible pipe 72.

In operation of the gas turbine engine 10 as part of a Lurgi coal gasification plant, the gas turbine engine is initially operated by burning in combustion chamber 50, high energy liquid fuel flowing from fuel inlet flexible supply pipes 72 through injectors 70 and leg portion 52A of each fuel burner 35. At the same time, a portion of the compressed air flowing from compressed air plenum 34 into pipe 32, via manifold 14, is bypassed, via crossover valve means 31 and pipe 33 into pipe 30 and manifold 28. This bypassed compressed air flows, via outlet openings 60 and nipples 28, into tubular members 52 for admixture with the liquid fuel emitted from injectors 70 so as to promote the vaporization of the fuel. The combustion in combustion chamber 50 is started by igniter 66 and maintained by the igniter until self-sustained combustion is attained. With gas turbine engine 20 operating sufficiently long enough to provide compressed air, via compressed air outlet manifold 14 and outlet pipe 32 for the production of LBG fuel in the coal gasification plant (not shown), LBG fuel is then fed by means of suitable valving to supply pipe 30 and fuel inlet manifold 28, thence into and through tubular members 52 and into combustion chamber 50. When LBG fuel is burned in combustion chamber 50, liquid fuel flow is stopped and combustion is thereby maintained by burning the LBG fuel in combustion chamber 50. This switch of fuels may be accomplished gradually by increasing LBG fuel flow while decreasing liquid fuel flow so that, during the transfer period, engine RPM can be maintained.

It is to be understood that the invention is not limited to fuel burner and combustor assemblies which comprise annular housings and a plurality of circumferentially spaced fuel burners as has been herein described in detail. It is within the scope and spirit of this invention that the fuel burner and combustor assembly may comprise a combustor housing of the tank or can type having one or a plurality of spaced burners and wherein a plurality of such fuel burner and combustor assemblies are circumferentially arranged within the casing of the gas turbine engine.

It is believed now readily apparent that the fuel burner and combustor assembly according to this invention provides the following:

1. low cost and maintenance and increased reliability by eliminating the need for the conventional combustor support pins;
2. no need for complex slipjoint connections between the fuel burners and combustor since both are part of a unitary assembly;
3. eliminates heretofore known potential misalignment problems during gas turbine engine operation and the need for providing between conventional support pins and fuel burner nozzles compensating flexible connections;
4. fixes the combustor against axial and lateral movement relative to the gas turbine engine casing while allowing radial movement relative to the casing;
5. has liquid and gaseous fuel capability which is achievable from one to the other without disassembly or reassembly of the fuel system because both fuels are emitted from the same burner nozzle;
6. the switch from one fuel to the other can be achieved without shutdown of the gas turbine engine; and
7. a wide range of operating speeds is possible since operation is not dependent on the instantaneous availability of LBG fuel.

It is not the intention hereof to restrict application of this invention by the figures and description thereof, but rather it should be understood that the present disclosure is to illustrate the concept and principle of the present invention and that changes or alterations thereto, obvious to one skilled in the art, would still come within the scope of this disclosure. Therefore, although but one preferred embodiment of the apparatus of this invention has been herein disclosed, it should be understood that the present invention is made by way of example only and that variations are possible without departing from the subject matter coming within the scope of the following claims, which claims are regarded as the invention.

What is claimed is:

1. A fuel burner and combustor assembly for a gas turbine engine having a casing, an air compressor section in said casing, a turbine section disposed within said casing in axial spaced relation to said air compressor section, and at least one fuel supply port means in the casing communicating with a source of fuel and extending radially thereto, the fuel burner and combustor assembly comprising (a) a housing disposed within the engine casing between the air compressor section and the turbine section and defining therein a combustion chamber;

(b) inlet port means in said housing communicating with the air compressor section and the combustion chamber to receive compressed air from said air compressor section and pass the same into the combustion chamber;

(c) said housing being closed at one end and open at the opposite end to pass gaseous products of combustion from said combustion chamber into the turbine section to drive the latter;

(d) at least one fuel burner attached at one end portion to said closed end of said housing and extending into the combustion chamber to pass fuel into the latter while the opposite end portion slidably engages said radially extending fuel supply port means for receiving fuel from the latter for passage through the fuel burner; and (e) said fuel supply port means and fuel burner coact to anchor the housing against lateral movement and against movement in one axial direction relative to the casing so that thermal growth of the housing is effect in the opposite direction toward the turbine section and to allow relative movement between the combustor and casing in a radial direction while maintaining fuel flow through the fuel burner.

2. The apparatus of claim 1 wherein seal means is provided between the fuel supply port means and the fuel burner.

3. The apparatus of claim 1 wherein said fuel burner is a hollow tubular member of generally L-shaped configuration.

4. The apparatus of claim 1 wherein said fuel supply port means communicates with a manifold.

5. The apparatus of claim 4 wherein said manifold is annular and surrounds the gas turbine.

6. The apparatus of claim 1 wherein said fuel supply port means comprises a nipple secured to the inner surface of the casing to project radially inwardly of the casing.

7. The apparatus of claim 6 wherein said fuel burner telescopically engages said fuel supply port means.

8. The apparatus of claim 7 wherein said nipple projects within the fuel burner and wherein seal means is disposed to seal the interstices between the nipple and fuel burner.

9. The apparatus of claim 8 wherein said fuel burner includes a fuel injector means and a flexible conduit connecting the fuel injector with a source of second fuel.

10. A fuel burner and combustor assembly for a gas turbine engine having a casing, an air compressor section in said casing, a turbine section disposed within said casing in axial spaced relation to said air compressor section, and at least one fuel supply port means in the casing communicating with a source of fuel and extending radially thereto, the fuel burner and combustor assembly comprising (a) a housing disposed within the engine casing in the space between the air compressor and turbine sections and defining therein a combustion chamber;

(b) inlet port means in said housing communicating with the air compressor section to receive compressed air and to pass the same into the combustion chamber;

(c) said housing being closed at the end adjacent the air compressor section and open at the end adjacent the turbine section to pass gaseous products of combustion into the turbine section to drive the latter;

(d) at least one fuel burner of hollow tubular, L-shaped configuration having one leg portion thereof attached to and extending into the combustion chamber while the other leg portion slidably engages said radially extending fuel supply port means so as to receive fuel from the latter for passage through the fuel burner; and (e) said fuel supply port means coacting with said fuel burner to anchor the combustor housing against lateral movement and movement in one axial direction relative to said casing so that thermal growth of the combustor housing is effected in the opposite direction toward the turbine section and to simultaneously allow relative movement between the combustor and casing in a radial direction.

11. The apparatus of claim 10 wherein said fuel supply port means includes a passageway in the casing and a nipple attached to the casing in register with the passageway and projecting radially inwardly.

12. The apparatus of claim 11 wherein said other leg portion of the fuel burner telescopically slidably engages said nipple so that relative radial movement with respect to the gas turbine engine can occur between the fuel burner and combustor assembly and said engine casing.

13. The apparatus of claim 12 wherein sealing means is provided between the other leg portion of the fuel burner and the nipple to prevent leakage of fuel through the interstices between the other leg portion and the nipple.

14. The apparatus of claim 1 wherein said fuel burner has a fuel injector disposed to inject a second fuel into said one leg portion for flow therethrough and into the combustion chamber.

15. The apparatus of claim 14 wherein a flexible fuel supply pipe is connected at one end to said fuel injector and to a source of a second fuel.

16. A fuel burner and combustor assembly for a gas turbine engine having a casing, an air compressor section in said casing, a turbine section disposed within said casing in axial spaced relation to said air compressor, and a plurality of circumferentially spaced fuel supply port connectors extending radially and inwardly from the casing and communicating with a source of fuel, the fuel burner and combustor assembly comprising (a) an annular housing disposed within the engine casing in the space between the air compressor and turbine sections and defining therein an annular combustion chamber;

(b) inlet port means in the housing communicating with the compressed air section to receive compressed air from the latter and pass the same into the combustion chamber;

(c) said housing having ports communicating the air compressor section with the combustion chamber to supply air for supporting combustion in the latter;

(d) said housing being closed at the end adjacent the air compressor section and open at the end adjacent the turbine section to pass gaseous products of combustion into the turbine section to drive the latter;

(e) a fuel burner for each of said fuel supply port connectors;

(f) each of said fuel burners being attached at one end portion to said closed end of the housing and extending into the combustion chamber to pass fuel into the latter while the opposite end portion telescopically engages its associated fuel supply port connector for receiving fuel from the latter; and (g) each of said fuel burners and its associated fuel supply port connector coacting to anchor the combustor housing against movement in one axial direction relative to the casing so that thermal growth of the combustor housing is allowed in a direction toward the turbine section and to simultaneously allow relative movement between the combustor and casing in a radial direction while maintaining flow of fuel through the fuel burner.

17. The apparatus of claim 16 wherein each of said fuel burners is of hollow-tubular, L-shaped construction and wherein each of said fuel supply port connectors is a nipple secured to the inner surface of the casing so that it projects radially inwardly toward the longitudinal axis of the gas turbine engine.

18. The apparatus of claim 16 wherein each of said fuel burners has a liquid fuel injector mounted thereon for discharge of fuel into fuel burners and wherein bypass means is provided for passing some of the compressed air from the air compressor section into each of said fuel burners to admix with the liquid fuel and promote vaporization of the liquid fuel.

* * * * *